US008854230B2

(12) United States Patent
Chen et al.

(10) Patent No.: US 8,854,230 B2
(45) **Date of Patent: *Oct. 7, 2014**

(54) TRAFFIC SIGNAL BROADCASTING, REPRODUCING

(75) Inventors: Ying Chen, Beijing (CN); Rong Yao Fu, Beijing (CN); Qian Ma, Beijing (CN); Hao Wang, Beijing (CN); Yue Da Xiong, Beijing (CN); Yuan Yuan, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/604,851

(22) Filed: Sep. 6, 2012

(65) Prior Publication Data

US 2013/0002451 A1 Jan. 3, 2013

Related U.S. Application Data

(63) Continuation of application No. 13/535,465, filed on Jun. 28, 2012, now abandoned.

(30) Foreign Application Priority Data

Jun. 30, 2011 (CN) ..... 2011 1 0180806

(51) Int. Cl.
*G08G 1/095* (2006.01)

(52) U.S. Cl.
USPC ..... 340/907; 340/905; 340/918; 340/932

(58) Field of Classification Search
CPC ..... G08G 1/00
USPC ..... 340/902, 905–907, 916, 925, 929, 944, 340/918, 932; 342/385; 434/112; 701/117, 701/210

See application file for complete search history.

(56) References Cited

U.S. PATENT DOCUMENTS

| | | | | |
|---|---|---|---|---|
| 6,516,273 | B1 | 2/2003 | Pierowicz et al. | |
| 6,590,507 | B2 * | 7/2003 | Burns | 340/995.13 |
| 7,327,280 | B2 * | 2/2008 | Bachelder et al. | 340/906 |
| 7,466,227 | B2 | 12/2008 | Chen et al. | |
| 7,764,194 | B2 | 7/2010 | Osanai | |
| 7,864,071 | B2 * | 1/2011 | Bachelder et al. | 340/906 |
| 8,130,119 | B2 * | 3/2012 | Mase | 340/907 |
| 8,274,404 | B2 * | 9/2012 | Sennett et al. | 340/944 |
| 8,462,017 | B2 * | 6/2013 | Sennett et al. | 340/925 |
| 8,487,780 | B2 * | 7/2013 | Edwardson | 340/906 |
| 2005/0134478 | A1 | 6/2005 | Mese et al. | |
| 2010/0073194 | A1 | 3/2010 | Ghazarian | |
| 2010/0117861 | A1 * | 5/2010 | Free | 340/929 |
| 2011/0018701 | A1 * | 1/2011 | Mizuno | 340/438 |
| 2011/0095906 | A1 * | 4/2011 | Stahlin | 340/905 |
| 2012/0249343 | A1 * | 10/2012 | Thomas | 340/905 |

* cited by examiner

*Primary Examiner* — Van T. Trieu
(74) *Attorney, Agent, or Firm* — Tutunjian & Bitetto, P.C.; Jennifer R. Davis

(57) ABSTRACT

Reducing traffic signal obstruction, through reproducing the contents of traffic signals, so the driver of a small vehicle blocked by a big vehicle also can be aware of the contents of traffic signals indicated by an obstructed traffic signal indicator. The system of reproducing traffic signals on a vehicle includes: a signal receiver, configured to receive the contents of traffic signals, wherein the contents of traffic signals is indicated by at least one traffic signal indicator; a signal processor, configured to determine whether to reproduce the received contents of traffic signals; and a reproducer, configured to reproduce the contents of traffic signals if it is determined to do so by the signal processor.

8 Claims, 9 Drawing Sheets

TRAFFIC SIGNAL BROADCASTING, REPRODUCING

CROSS REFERENCE TO RELATED APPLICATION

This application is a continuation of and claims priority from U.S. patent application Ser. No. 13/535,465, filed Jun. 28, 2012, which in turn claims priority under 35 U.S.C. 119 from Chinese Patent Application Number 201110180806.X, filed Jun. 30, 2011, the entire contents of both are incorporated herein by reference.

BACKGROUND OF THE INVENTION

1. Field of the Invention

The present invention generally relates to a method and system for processing traffic signals, and more specifically, to a method and system for broadcasting and reproducing traffic signals.

2. Description of Related Art

It is well known that violating traffic rules may cause traffic jams, lead to traffic accidents, and may impose economic punishments on the drivers. In practice, however, there are cases in which drivers have broken traffic rules because they were unable to see traffic signals, but not by intention or negligence.

For example, FIG. 1 is a schematic diagram of an intersection. When a car G is driving towards the intersection following a bus F, if bus F happens to get across the limit line just before the last moment of a green light which is turned into a red light immediately, the driver of car G most likely can not catch the light change, and therefore, entering into the intersection following bus F, causing to violate, by the car driver, the traffic rule indicated by the traffic light A. If the label F represents a truck in utter disregard of traffic rules instead of the bus in FIG. 1, it is likely for the car G which is obstructed by the truck to offend the traffic light indication tailing after the truck for unable to see the traffic light A. As a result of running a red light, the car driver will not only be imposed an economic punishment, but even may cause a serious traffic accident.

Such a problem is especially prominent on crowed urban roads, where vehicles often keep away from each other a relative short distance, the driver of a small car usually has his vision blocked by big vehicles in front of him, as result, can not recognize the indication of traffic signal indicators in time.

If a small car driving after a big truck, the driver of the small car is bothered for not only traffic lights but also other traffic signal indicators might be obstructed. For example, some roads are provided with road condition indications to indicate road conditions ahead, including jam or no jam. If the driver of the small car has his vision blocked by the big truck, he is unable to catch sight of the signs on those road condition indicators in time, therefore cannot adjust driving lines in time.

At present, however, there is not an effective solution for such a problem.

SUMMARY OF THE INVENTION

According to one aspect of the present invention, a traffic signal broadcasting system includes: a traffic signal indicator identifier, configured to identify at least one traffic signal indicator; a traffic signal acquirer, configured to acquire the contents of traffic signals indicated by the traffic signal indicator; and a signal transmitter, configured to transmit the contents of the traffic signals.

According to another aspect of the present invention, a method of broadcasting traffic signals includes the steps of: identifying at least one traffic signal indicator; acquiring the contents of traffic signals indicated by the traffic signal indicator; and transmitting the contents of traffic signals.

In still another aspect of the present invention, a method of reproducing traffic signals on a vehicle includes the steps of: receiving the contents of traffic signals, where the contents of traffic signals is indicated by at least one traffic signal indicator; determining whether to reproduce the received contents of traffic signals; and reproducing the contents of traffic signals in response to a determination to reproduce the contents of traffic signals.

BRIEF DESCRIPTION OF THE DRAWINGS

The drawings referenced in the present application are only used to exemplify typical embodiments of the present invention and should not be considered to be limiting the scope of the present invention.

DETAILED DESCRIPTION OF PREFERRED EMBODIMENTS

Figure 1:
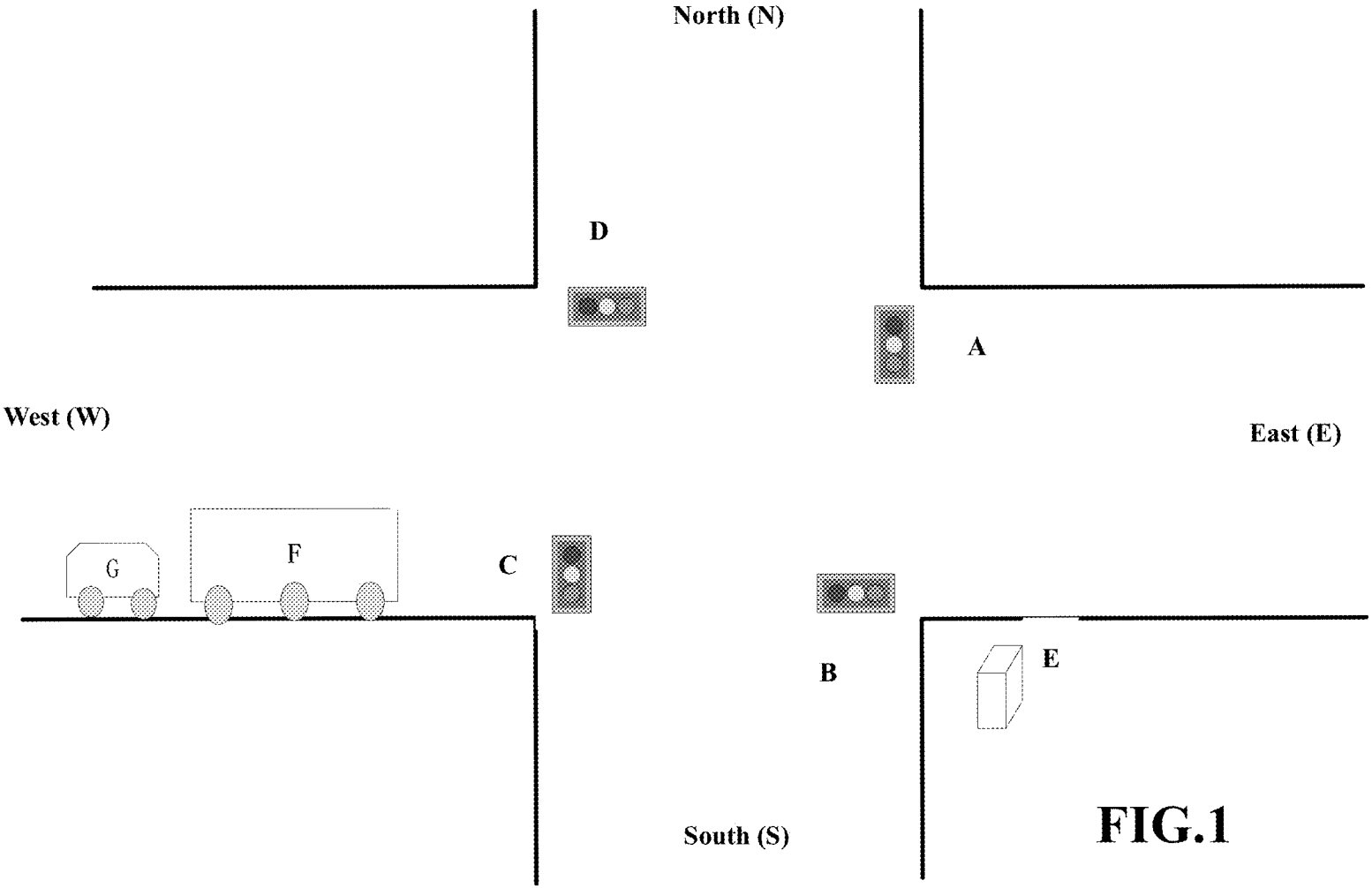
FIG. 1 is a schematic diagram of an intersection.

The terminology used herein is for the purpose of describing particular embodiments only and is not intended to be limiting of the present invention. As used herein, the singular forms "a" and "the" are intended to include the plural forms as well, unless the context clearly indicates otherwise. It will be further understood that the term "includes" when used in this specification, specifies the presence of stated features, integers, steps, operations, elements, and/or components, but do not preclude the presence or addition of one or more other features, integers, steps, operations, elements, components, and/or groups thereof.

The corresponding structures, materials, acts, and equivalents of all apparatus or steps plus function elements in the claims are intended to include any structure, material, or act for performing the function in combination with other claimed elements as specifically claimed. The description of the present invention has been presented for purposes of illustration and description, but is not intended to be exhaustive or limited to the present invention in the form disclosed. Many modifications and variations will be apparent to those of ordinary skill in the art without departing from the scope and spirit of the present invention. The embodiment was chosen and described in order to best explain the principles of the present invention and the practical application, and to enable those of ordinary skill in the art to understand the present invention for various embodiments with various modifications as are suited to the particular use contemplated.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the present invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

FIG. 1 is a schematic diagram of an intersection, which is a typical crossing. There are four traffic lights placed at four intersection corners to provide traffic indications for vehicles running in corresponding directions. In the direction from west to east, a bus is driving towards the crossing followed by a car G. A traffic light controller E is set up at the south east corner of the crossing, which controls the four traffic lights.

Figure 2B:
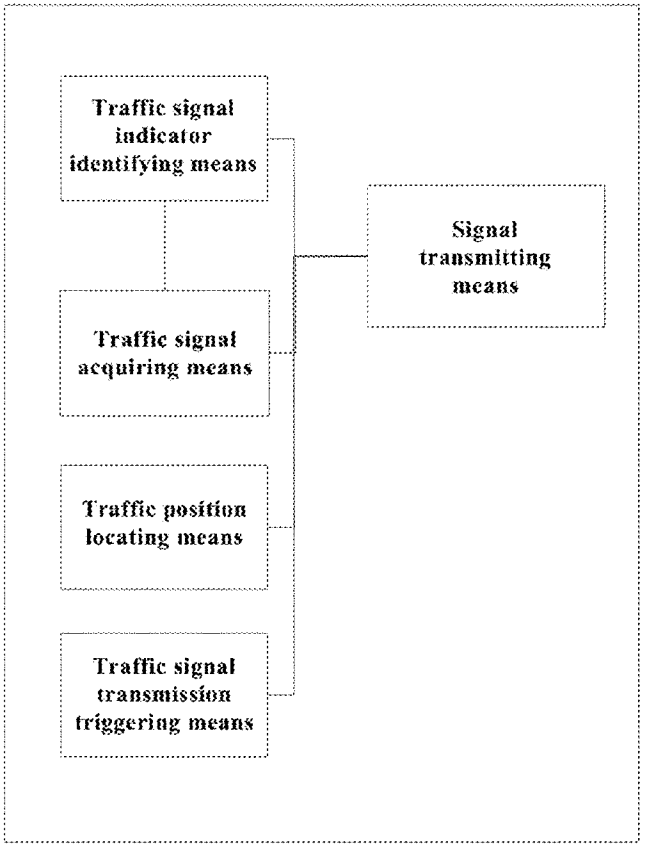
FIG. 2B is a block diagram of a traffic signal broadcasting system according to another embodiment of the present invention.
Figure 2A:
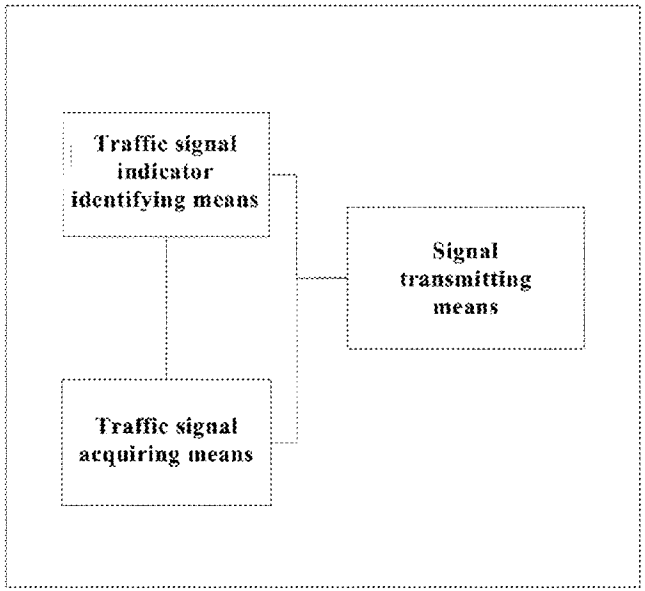
FIG. 2A is a block diagram of a traffic signal broadcasting system according to one embodiment of the present invention.

FIG. 2A is a block diagram of a system for traffic signal broadcasting according to one embodiment of the present invention. The present invention provides a traffic signal broadcasting system, which may include: a traffic signal indicator identifier, configured to identify at least one traffic signal indicator; a traffic signal acquirer configured to acquire the contents of traffic signals indicated by the at least one traffic signal indicator; and a signal transmitter, configured to transmit the contents of the traffic signals.

In different embodiments, the traffic signal broadcasting system can be mounted on the traffic light controller E or can be mounted separately; alternatively, a portion of the traffic signal broadcasting system can be mounted on the traffic light controller E, and other portions can be mounted separately. Also, every device of the traffic signal broadcasting system can be positioned on the same hardware device or can be located on different hardware devices.

The traffic signal indicators can be various devices for indicating traffic signals, for example, traffic lights, lane signs, and so on. The traffic signal indicator identifier is configured to identify at least one traffic signal indicator. For example, in the example shown in FIG. 1, the traffic signal indicator identifier is configured to identify which traffic lights is sending a traffic signal indication. The traffic signal acquirer is configured to acquire the contents of traffic signals indicated by the at least one traffic signal indicator. For example, in the example shown in FIG. 1, the traffic signal acquirer is configured to acquire contents indicated by one or more traffic lights, including indicated direction and status in the corresponding direction.

Referring to table 1 below, in the example shown in FIG. 1, the traffic signal indicator identifier acquires corresponding information about traffic lights from traffic light controller E, traffic light identifications are stored in the first column of table 1. Traffic signals acquired by the traffic signal acquirer is stored in the second and third columns in table 1. Certainly, the contents of table 1 continuously vary with traffic lights.

TABLE 1

| | Traffic signal | |
|---|---|---|
| Traffic signal indicator | direction | status |
| A | Go straight | green |
| A | Turn right | yellow |
| A | Turn left | red |
| B | Go straight | green |
| B | Turn right | yellow |
| B | Turn left | red |
| . . . | . . . | . . . |

Optionally, the traffic signal indicator identifier can further identify a traffic light with the driving direction of vehicles denoted by the traffic light. For example, traffic light A in FIG. 1 denotes the driving direction from west to east, and can be identified by "from W to E". Specific exemplary identifications are shown in table 2 below:

TABLE 2

| Traffic signal indicator | | Traffic signal | |
|---|---|---|---|
| from | to | direction | status |
| W | E | Go straight | green |
| W | E | Turn right | yellow |
| W | E | Turn left | red |
| N | S | Go straight | red |
| N | S | Turn right | green |
| N | S | Turn left | red |
| . . . | | . . . | . . . |

In another embodiment, the driving direction also can be, for example, "from NE to SW", in which case the traffic light indicator may indicate vehicles driving from northeast to southwest, and thereby, the present invention is also applicable to roads in other orientations.

According to another embodiment of the present invention, driving direction of vehicles can be represented in a more precise manner, for example, represented by an angle from 0 to 360 degrees. For example, a traffic signal indicator indicating driving direction of vehicles from west by south 30 degrees to east by north 30 degrees can be represented as 30. Optionally, if driving direction of vehicles is represented by angles as above, some redundant information can be added when determining specific driving direction of vehicles, for example, +/−5 degrees so that the traffic signal indicator is also suitable to vehicles driving from west by south 25 degrees to east by north 25 degrees.

The present invention does not exclude representations of driving direction of vehicles in other manners.

Also, the traffic signal broadcasting system is applicable not only to crossroads but also to traffic signal broadcasting at any other positions, including T crossings, irregular intersections, high ways, roundabouts and so on. As mentioned above, however, for different positions, the traffic signal indication identifier can identify traffic signal indicators in the same or different ways.

Returning to FIG. 2A, the signal transmitter is configured to transmit the contents of traffic signals. The present invention does not have any limitations on communication modes for transmitting wireless signals, including FM, WiFi, Bluetooth and any other wireless communication modes. Those skilled in the art will understand, with respect to FM, a transmitter of 5 W generally has a transmission radius of about 1 kilometer, and for a transmitter of 10 W, about 2.5 kilometers. With respect to WiFi, depending on devices and shields, it has a transmission radius ranging from 10 to 500 meter, and its coverage range can be adjusted by tuning the power of routers. With respect to Bluetooth, the traditional Bluetooth RF distance is 30 feet or 10 meters; as to Bluetooth version 4.0 newly emerged, manufactures may have an option for optimizing the distance to exceed 200 feet. The contents of traffic signals will be particularly encoded according to specific requirements of wireless communication modes. The signal receiver used in the traffic signal reproducing system for vehicles will use the same communication mode to receive the transmitted contents, and particular details are described in detail below.

In one embodiment of the present invention, traffic light identifications identified by the traffic signal indicator identifier (for example, "A" in table 1, "from W to E" in table 2) will be transmitted along with traffic signals. If the traffic light identification is "from W to E", the traffic signal reproducing system of vehicle F can determine, after receiving the traffic light identification, which traffic light is applicable for indicating traffic signals based on its own driving direction. If the traffic light identification is "A" (or any other identifications rather than explicit driving direction), there needs an agreement between the traffic signal broadcasting system and the traffic signal reproducing system about which driving direction is indicated by that traffic light identification, for example, representing "From W to E" by identification "A". Such agreement can be achieved by means of handshaking signals in advance or can be set previously in the traffic signal broadcasting system and the traffic signal reproducing system.

In another embodiment of the present invention, for instance, there is a traffic light indicator placed near a road, which is used to indicate lane information ahead; the traffic light indicator is not positioned at an intersection, and is used to indicate traffic signals for vehicles on a one-way road; therefore, the contents indicated by the traffic light indicator is applicable to all passing vehicles. In such example, the vehicle-mounted traffic signal reproducing system does not need to determine whether traffic signals are applicable, and therefore, it is not necessary for the traffic signal broadcasting system to transmit identifications of traffic signal indicators.

Figure 6:
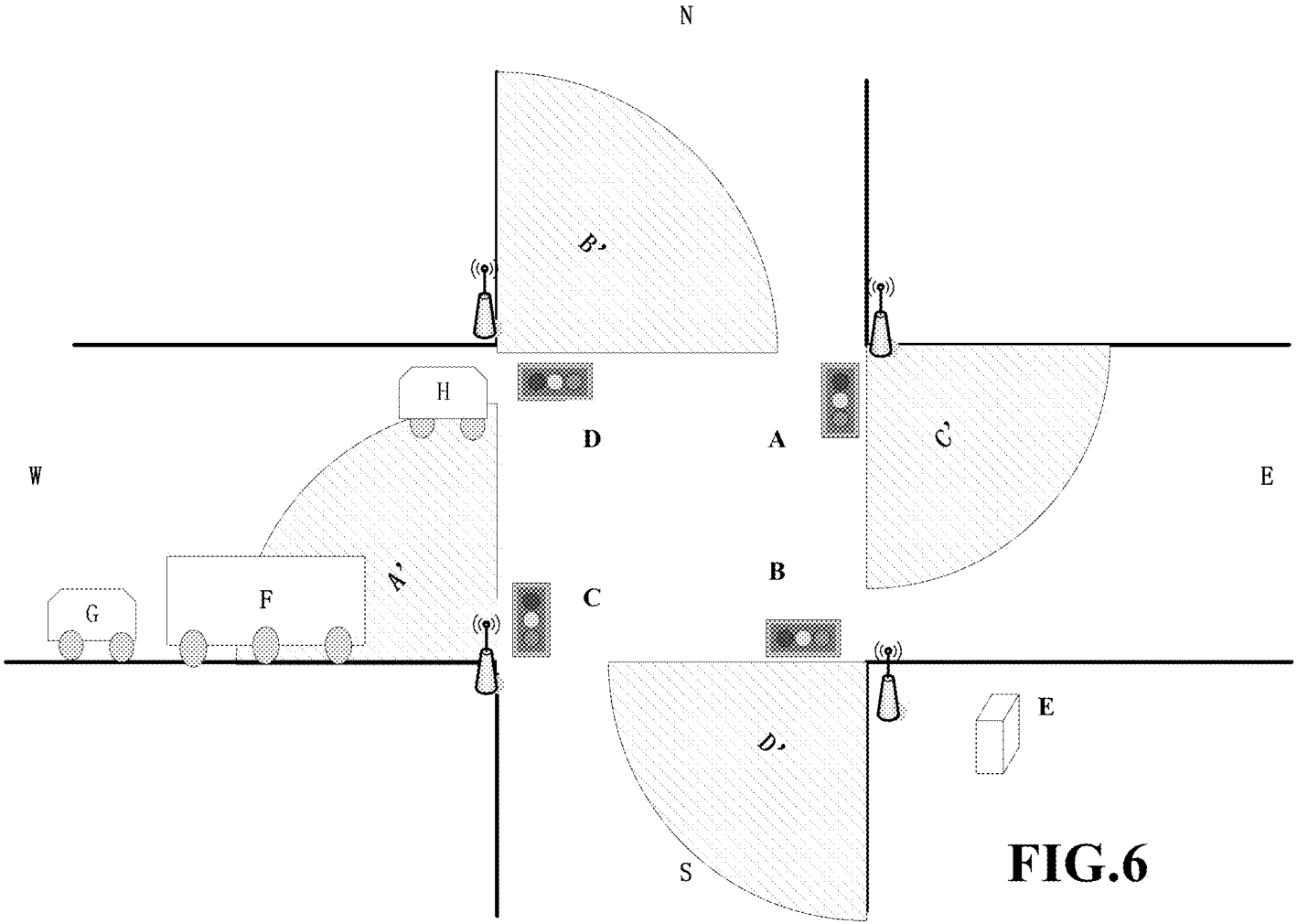
FIG. 6 is a schematic diagram of an intersection which adopts a directional antenna to transmitting traffic signals.

According to one embodiment of the present invention, the signal transmitter transmit through a directional antenna. A "directional antenna" refers to an antenna that can transmit/receive electromagnetic waves in one or more particular directions with a very strong intensity, but can transmit/receive zero or minimal electromagnetic waves on other directions. With a directional antenna, traffic signals can be directly transmitted to vehicles that need to receive indications from the traffic signal indicator. FIG. 6 is a diagram of a crossroad provided with directional antennas to transmit traffic signals. There are four transmitters located on four corners of the crossroad respectively, each of which has a transmission region covering a sector. The four transmitters have transmission regions A', B', C' and D' respectively, wherein the directional antenna of region A' transmits traffic signals of traffic light A to vehicles traveling through region A', the directional antenna of region B' transmits traffic signals of traffic light B to vehicles traveling through region B', the directional antenna of region C' transmits traffic signals of traffic light C to vehicles traveling through region C', and the directional antenna of region D' transmits traffic signals of traffic light D to vehicles traveling through region D'. Except that bus F can receive traffic signals of traffic light A transmitted from the directional antenna in region A', a car H driving towards west also can receive traffic signals of traffic light A transmitted from the directional antenna in region A'. After the traffic signal reproducing system on car H receives the contents of traffic signals, it can determine whether to reproduce the received contents of traffic signals based on position information about car H and the crossroad shown in FIG. 6. The detailed scheme is discussed below.

Furthermore, the regions of directional antennas can be adjusted based on the shapes of roads, and the regions in FIG. 6 are merely illustrative.

FIG. 2B is a block diagram of a traffic signal broadcasting system according to another embodiment of the present invention. The system of FIG. 2B includes: a traffic signal indicator identifier, a traffic signal acquirer, a signal transmitter, a traffic position locator, and a traffic signal transmission trigger. Wherein, the traffic signal indicator identifier, traffic signal acquirer, signal transmitter have substantially the same functions and effects as that of FIG. 1B, which will not be repeated herein.

The traffic position locator in FIG. 2B is configured to acquire position information about traffic positions associated with the at least one traffic signal indicator. The signal transmitter in FIG. 2B is also configured to transmit the position information about traffic positions. Acquiring position information about traffic positions associated with the at least one traffic signal indicator is helpful to determine whether a vehicle has travelled through those traffic positions and/or which one of a plurality traffic positions the vehicle is closer to.

Taking the crossroad of FIG. 1 as an example for illustration below, assuming bus F has passed through the crossroad and continues to run toward east on the road east to the crossroad, at this point, it is not required to reproduce traffic signals of that crossroad on bus F. In order to achieve not to reproduce traffic signals associated with a certain traffic position after the bus has travelled through the position, the traffic signal transmitting system may further transmit position information about that traffic position, for example, the central position of the crossroad where the traffic signal indicator is located. The contents of traffic signals transmitted by the signal transmitter can be shown as table 3 below.

TABLE 3

| Traffic signal indicator | | Traffic signal | | Position information about traffic |
|---|---|---|---|---|
| from | to | direction | status | position |
| W | E | Go straight | green | 116.46° E, |
| W | E | Turn right | yellow | 39.92° N |
| W | E | Turn left | red | |
| N | S | Go straight | red | |
| N | S | Turn right | green | |
| N | S | Turn left | red | |
| ... | ... | ... | | |

116.46° E and 39.92° N in table 3 represent longitude and latitude coordinates of the center of the crossroad. After receiving the above coordinates, Bus F can compare it with its own position information to determine whether it has passed through the crossroad and whether not to reproduce traffic signals. Details are described below.

According to another embodiment, position information of every traffic light can be more precisely located, so as to evaluate whether a vehicle has passed through a certain traffic light more accurately. The transmitted position information about traffic positions is shown as table 4.

TABLE 4

| Traffic signal indicator | | Traffic signal | | Position information about traffic |
|---|---|---|---|---|
| from | to | direction | status | position |
| W | E | Go straight | green | 116.46° E, |
| W | E | Turn right | yellow | 39.92° N |
| W | E | Turn left | red | |
| N | S | Go straight | red | 116.45° E, |
| N | S | Turn right | green | 39.91° N |
| N | S | Turn left | red | |
| ... | ... | ... | | |

The position information about traffic positions can be obtained in various manners, including through a GPS locating device, or through position information marked on a map in advance.

Those skilled in the art will appreciate that the present invention also can transmit no position information about traffic positions, in which case vehicles may always reproduce traffic signals until they can not receive wireless signals with sufficient intensity from the traffic signal broadcasting system.

According to another embodiment of the present invention, the traffic signal broadcasting system further includes a traffic signal transmission trigger, which is configured to determine a trigger timing for the transmission of contents of traffic signals by the signal transmitter, wherein the trigger timing is a certain period of time before a change in the contents of traffic signals. For example, assume a red light turns to a yellow light after 55 seconds, which turns to a green light after 5 seconds, then turns to a yellow light after 55 seconds, and then turns to a red light after 5 seconds, and the like. In order to prevent frequent traffic signal transmitting and reproducing, the transmitter can merely start the transmission of contents of traffic signals 15 seconds just before the switching of a red light into a yellow light (or switching from a green light to a yellow light). The traffic signal transmission trigger can be used to determine when to transmit the contents of traffic signals to vehicles. In the present embodiment, the rules for triggering the transmission of traffic signals are shown in table 5 below.

TABLE 5

| Traffic light status | time | Whether to trigger the transmission of traffic signals |
|---|---|---|
| red | 1-40 s | No transmission |
| red | 41-55 s | transmission |
| yellow | 56-60 s | transmission |
| green | 61-70 s | transmission |
| green | 71-100 s | No transmission |
| green | 101-115 s | transmission |
| yellow | 116-120 s | transmission |

Figure 3B:
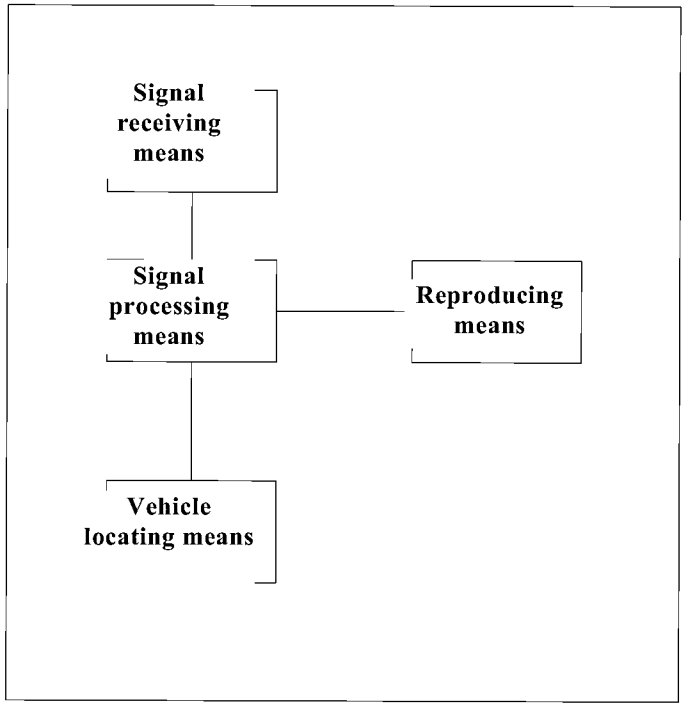
FIG. 3B is a block diagram of a system block diagram of a system for reproducing traffic signals on a vehicle according to another embodiment of the present invention.
Figure 3A:
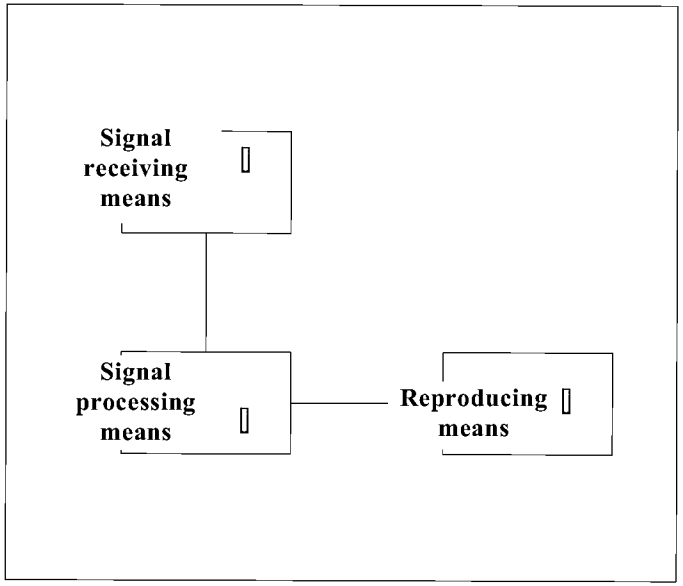
FIG. 3A is a block diagram of a system block diagram of a system for reproducing traffic signals on a vehicle according to one embodiment of the present invention.

FIG. 3A is a block diagram of a traffic signal reproducing system on vehicles according to one embodiment of the present invention. The traffic signal reproducing system includes: a signal receiver, configured to receive the contents of traffic signals, wherein the contents of traffic signals are indicated by at least one traffic signal indicator; a signal processor configured to determine whether to reproduce the received contents of traffic signals; and a reproducer configured to reproduce the contents of traffic signals if it is determined to reproduce the contents of traffic signals by the signal processor.

The signal receiver receives the contents of traffic signals transmitted by the signal transmitter of the traffic signal broadcasting system, for example, the contents indicated by one or more traffic lights, including indication directions and the status on the corresponding directions. The signal receiver is appropriate to use the same wireless communication protocol and communication mode as the traffic signal transmitter. The signal receiver sends the received contents of traffic signals to the signal processor.

The signal processor determines whether to reproduce the received contents of traffic signals. According to one embodiment of the present invention, the signal processor further determine whether to reproduce the received contents of traffic signals based on whether the driving direction of a vehicle is identical to the direction denoted by the at least one traffic signal indicator. For example, if the signal receiver receives the contents of traffic signals as shown in table 2 above, it is necessary for the signal processor to determine which traffic signal indicator denotes the appropriate contents of traffic signals.

Figure 5:
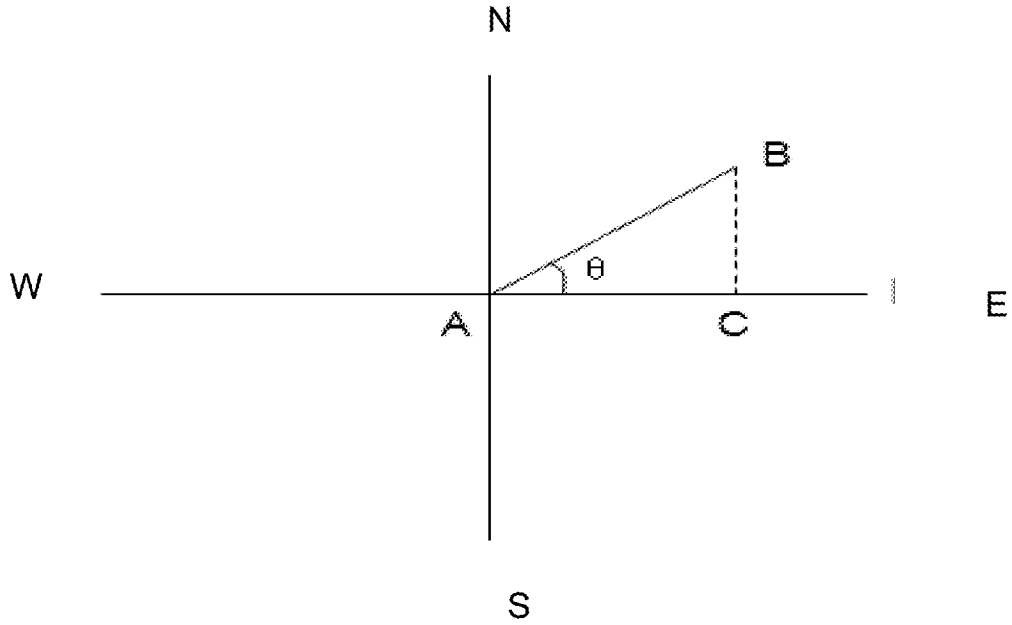
FIG. 5 is a schematic diagram of an algorithm for calculating vehicle driving direction according to one embodiment of the present invention.

There are many methods that can be used to determine the driving direction of a vehicle. According to one embodiment of the present invention, the driving direction of a vehicle can be evaluated through calculating changes in position of two points during the traveling of the vehicle. For example, a vehicle locator can be provided in the traffic signal reproducing system for acquiring the position information of a vehicle at a certain time. FIG. 5 is a schematic diagram of an algorithm for vehicle driving direction evaluation. Taking FIG. 5 as an example, if a vehicle is at a position A at time T0, which has longitude and latitude coordinates (LonA, LatA), and, at time T1, is at a position B having longitude and latitude coordinates (LonB, LatB), the driving direction of the vehicle can be simply obtained through calculating the angle θ between the longitude and latitude coordinates of position A and position B. According to a further embodiment, in order to prevent errors in determinations due to lane changing of vehicles, it is possible to take an integrated calculation of position information of a vehicle from position information at multiple times. For example, in addition to the longitude and latitude coordinates of points A, B, the longitude and latitude coordinates of points C, D also can be recorded, so that the driving direction of the vehicle can be determined through averaging the angle θAB between points A, B and the angle θCD between points C, D. Through obtaining the vehicle-driving direction, it is possible for the information processor to determine whether the vehicle-driving direction is identical with the driving direction denoted by the traffic signal indicator, and then determine which traffic signal indicator can provide appropriate traffic signals.

According to another embodiment of the present invention, electronic compasses and the like devices can be used for determining the vehicle-driving direction. Electronic compasses are common in mobile telephones nowadays, some of which are implemented with the support of hardware magnetometers, and some are implemented based on other principles. The details of those implementations are omitted herein.

Figure 4C:
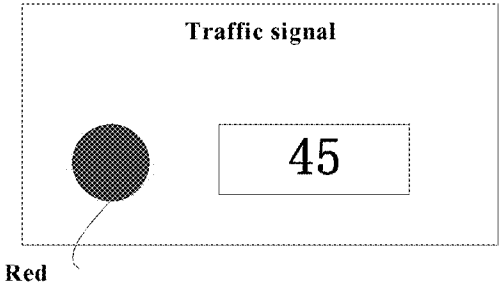
FIGS. 4A through 4H are schematic diagrams of reproducing traffic signals according to a plurality of embodiments of the present invention.
Figure 4D:
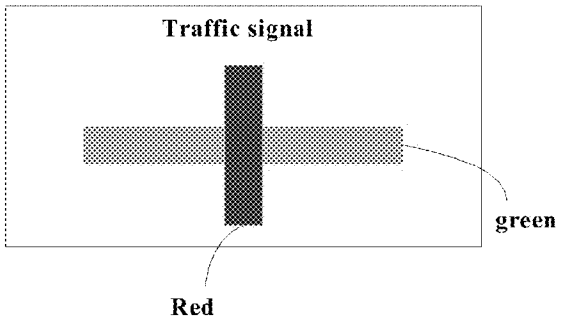
Figure 4A:
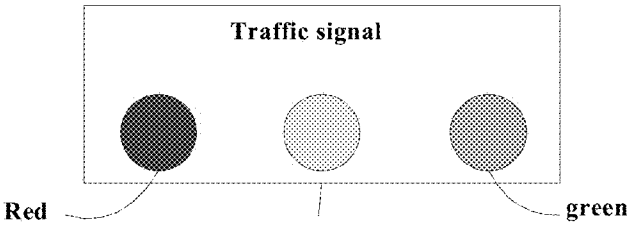
Figure 4B:
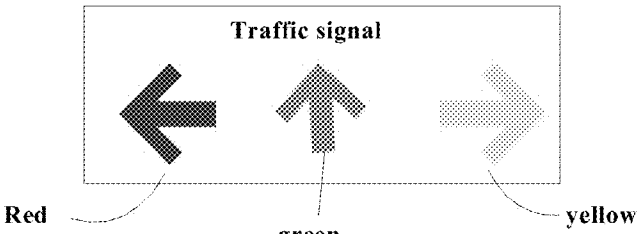
Figure 4G:
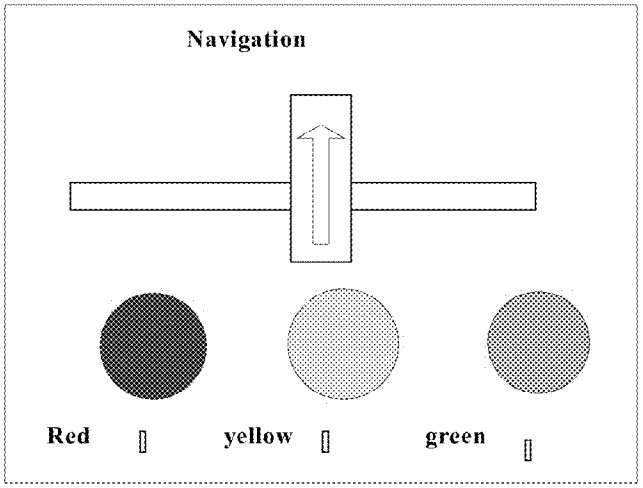
Figure 4H:
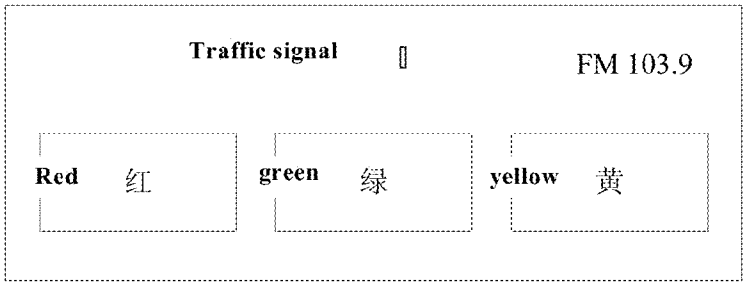
Figure 4E:
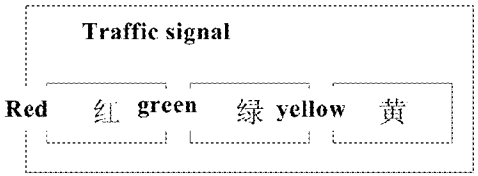
Figure 4F:
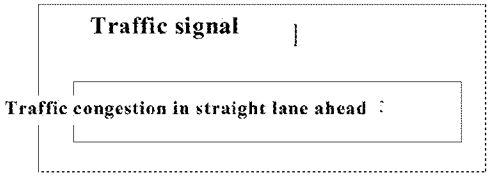

Returning to FIG. 3A, the reproducer is configured to reproduce the contents of traffic signals if it is determined by the signal processor to do so. The reproduced contents of traffic signals can be texts, graphs and speeches. The reproducer can directly reproduce the contents of traffic signals, for example, graphic information of traffic signals is directly reproduced in FIGS. 4A, 4B and 4E, and graphic and text information are directly reproduced in FIG. 4D. Moreover, the contents of traffic signals can be converted by the reproducer, such as converted from red, yellow, green graphic information into red, yellow, green text information (as shown in FIGS. 4C, 4F); alternatively, text information can be converted into speech information to be reproduced in a speech manner through TTS techniques by the reproducer, such as "red light for going straight" (not shown).

According to one embodiment of the present invention, the reproducer is mounted on a visible position outside of vehicles, for example, the LED display on the back of bus F, so that in car G behind bus F the driver's vision can not be obstructed by bus F.

According to another embodiment of the present invention, the reproducer is mounted on a position visible to the driver of a vehicle. For example, it can be positioned in the proximity to the instrument panel of the vehicle separately, in so doing, rather than resorting to the reproducer located on the back of bus F, the driver of car G can directly read the reproduced contents of traffic signals in his own car. In this embodiment, the reproducer can be mounted in a scope visible to drivers separately or in combination with other devices already in some vehicles, such as in combination with a portable navigation device (as shown in FIG. 4G) or in combination with the screen of a FM radio on a vehicle to utilize the existing screen resource (as shown in FIG. 4H).

According to another embodiment of the present invention, in addition to the contents of traffic signals, the signal receiver can further receive position information about a traffic position associated with the at least one traffic signal indicator. The signal processor is further configured to determine whether to reproduce the contents of traffic signals based on the relationship between the vehicle position information and the position information of the traffic position. In doing so, the contents of traffic signals will not be reproduced after the vehicle is far away from an intersection. For example, if the signal receiver has received position information 116.46° E, 39.92° N about the center of a crossroad as shown in table 3, the signal processor can determine whether the vehicle has passed through the crossroad through comparing the present position information of the vehicle with the position information of the crossroad center. It is not required to reproduce the contents of traffic signals, if the crossroad has been passed through. Hence, the reproducing mean is further configured to cancel the reproducing of traffic signal contents if the signal processor determines not to reproduce the contents of traffic signals based on the relationship between the vehicle position information and the position information of the traffic position.

According to another embodiment of the present invention, if traffic signal contents are transmitted from traffic signal broadcasting systems of two intersections spaced with a short distance, the traffic signal reproducing system on a vehicle will receive multiple contents of traffic signals from multiple signal transmitter. For example, if two crossroads 1 and 2 are closer to each other, when a vehicle has just passed through crossroad 1 and is driving toward crossroad 2, it can receive the contents of traffic signals transmitted from signal transmitter of the two crossroads, and thus it is required for the vehicle to determine which traffic signal indicator should have its indicated contents reproduced. According to the disclosure above, if the traffic signal reproducing system in the vehicle is aware of position information and driving direction of the vehicle, the signal processor of the traffic signal reproducing system can determine that the traffic signal reproducing system should reproduce traffic signals indicated by the traffic signal indicator of crossroad 2 based on position information and driving direction of the vehicle, and the traffic position information of the two crossroads.

FIG. 3B is a block diagram of a system for reproducing traffic signals on vehicles according to another embodiment of the present invention. FIG. 3B includes: a signal receiver, a signal processor, a reproducer, and a vehicle locator. The signal receiver, signal processor, and reproducer have substantially the same functions as those corresponding ones of FIG. 3A, the description of which is omitted here. As to the vehicle locator, such as a GPS locator, which has been described in this context, it can acquire location information of a vehicle, and accordingly, facilitate the evaluation of vehicle driving direction or determining whether the vehicle has passed through a crossroad or other traffic positions.

Figure 7:
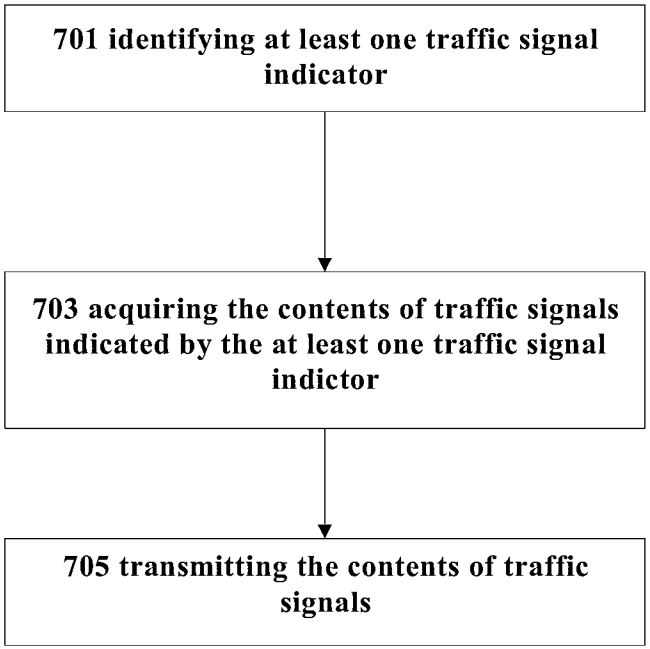
FIG. 7 is a flow chart of a method of broadcasting traffic signals according to one embodiment of the present invention.

FIG. 7 is a flow chart of a method of broadcasting traffic signals according to one embodiment of the present invention. At step 701, at least one traffic signal indicator is identified, for example, a traffic light or multiple traffic lights. At step 703, the contents of traffic signals denoted by the at least one traffic light are acquired, for example, the direction represented by the traffic light and traffic light state on the corresponding direction. At step 705, the contents of traffic signals are transmitted through various wireless communication modes, for example, FM, WiFi, and Bluetooth, etc.

According to one embodiment of the present invention, the method of broadcasting traffic signals further includes acquiring position information about traffic positions associated with the at least one traffic signal indicator; and transmitting the contents of traffic signals further includes transmits position information about those traffic positions.

According to another embodiment of the present invention, the method of broadcasting traffic signals further includes determining a triggering time for the transmitter to transmit the contents of traffic signals, which can be a period of time before the transmission of the contents of traffic signals.

According to another embodiment of the present invention, identifying at least one traffic signal indicator further includes identifying the traffic signal indicator according to vehicle driving direction represented by the traffic signal indicator.

Other aspects of the traffic signal broadcasting method of FIG. 7 have been described in the previous description of the traffic signal broadcasting system, and will not be repeated herein.

Figure 8:
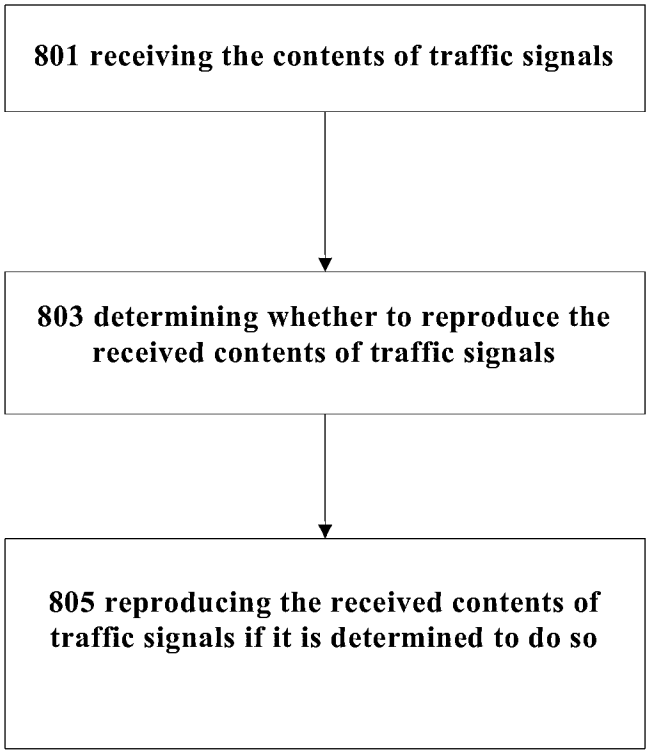
FIG. 8 is a flow chart of a method of reproducing traffic signals on a vehicle according to another embodiment of the present invention.

FIG. 8 is a flow chart of a method of reproducing traffic signals on a vehicle according to another embodiment of the present invention. The method of reproducing traffic signals shown in FIG. 8 includes: at step 801, receiving the contents of traffic signals indicated by at least one traffic signal indicator; at step 803, determining whether to reproduce the received contents of traffic signals; at step 805, reproducing the contents of traffic signals if it is determined to do so.

According to one embodiment of the present invention, the traffic signal reproducing method further includes acquiring position information of the vehicle.

According to another embodiment of the present invention, determining whether to reproduce the received contents of traffic signals includes determining whether to reproduce the contents of traffic signals according to the consistency of the driving direction of the vehicle with the direction represented by the at least one traffic signal indicator.

According to another embodiment of the present invention, receiving the contents of traffic signals further includes receiving position information about traffic positions associated with the at least one traffic signal indicator, and determining whether to reproduce the received contents of traffic signals further includes: determining whether to reproduce the contents of traffic signals based on the relationship between the position information of the vehicle and the position information of the traffic positions.

Other aspects of the traffic signal reproducing method of FIG. 8 have been described in the previous description of the traffic signal reproducing system, and will not be repeated herein.

Figure 9:
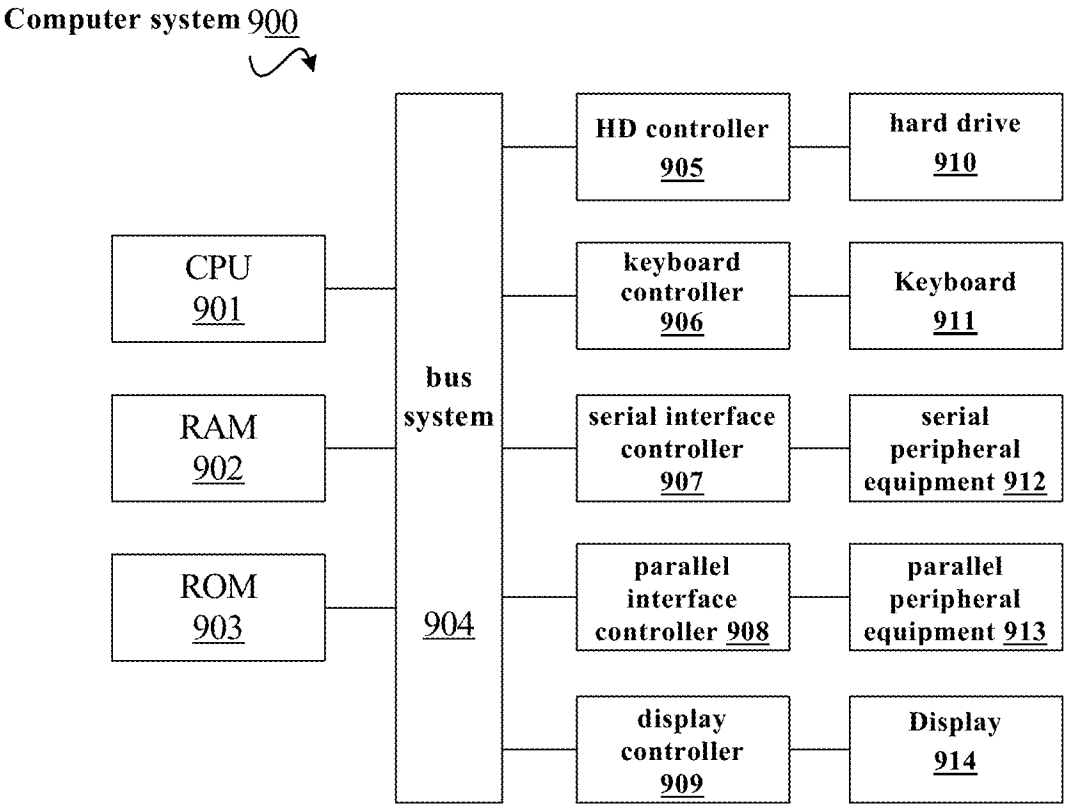
FIG. 9 is a block diagram of an exemplary computing system applicable to implement the present invention.

FIG. 9 is a block diagram of an exemplary computing system applicable to implement the present invention. As shown, the computer system 900 may include: CPU (Central Process Unit) 901, RAM (Random Access Memory) 902, ROM (Read Only Memory) 903, System Bus 904, Hard Drive Controller 905, Keyboard Controller 906, Serial Interface Controller 907, Parallel Interface Controller 908, Display Controller 909, Hard Drive 910, Keyboard 911, Serial Peripheral Equipment 912, Parallel Peripheral Equipment 913 and Display 914. Among above devices, CPU 901, RAM 902, ROM 903, Hard Drive Controller 905, Keyboard Controller 906, Serial Interface Controller 907, Parallel Interface Controller 908 and Display Controller 909 are coupled to the System Bus 904. Hard Drive 910 is coupled to Hard Drive Controller 905. Keyboard 911 is coupled to Keyboard Controller 906. Serial Peripheral Equipment 912 is coupled to Serial Interface Controller 907. Parallel Peripheral Equipment 913 is coupled to Parallel Interface Controller 908. And, Display 914 is coupled to Display Controller 909. It should be understood that the structure as shown in FIG. 9 is only for the exemplary purpose rather than any limitation to the present invention. In some cases, some devices may be added to or removed based on specific situations.

Many advantages can be provided by various embodiments of the present invention, including those listed in the description of the present invention, or those that can be deduced from the technical schemes of the present invention. Regardless whether an embodiment has all those advantages contained or whether such advantages are conceived to achieve essential improvement, they are not be intended to be limiting of the present invention. Meanwhile, various embodiments set forth above are merely for the purpose of description of the present invention, and various modifications and changes to the above embodiments can occur to those skilled in the art without departing from the essentials of the present invention. The scope of this invention is fully defined by appended claims.

What is claimed is:

1. A method of broadcasting traffic signals, comprising the steps of:

identifying at least one traffic signal indicator;

acquiring contents of traffic signals indicated by the at least one traffic signal indicator;

transmitting the contents of traffic signals; and determining a trigger time for transmitting the contents of traffic signals by the signal transmitter using a traffic signal transmission trigger.

2. The method according to claim 1, further comprising the step of:

acquiring position information of traffic positions associated with the at least one traffic signal indicator; and wherein the step of transmitting the contents of traffic signals further comprises transmitting the position information of the traffic positions.

3. The method according to claim 1, wherein the trigger time is a period of time before the occurrence of content changes in traffic signals.

4. The system according to claim 1, wherein the step of identifying at least one traffic signal indicator further comprises identifying at least one traffic signal indicator according to a vehicle driving direction represented by the traffic signal indicator.

5. A method of reproducing traffic signals on a vehicle, comprising:

receiving the contents of traffic signals, wherein the contents of traffic signals is indicated by at least one traffic signal indicator;

determining whether to reproduce the received contents of traffic signals; and reproducing the contents of traffic signals in response to a determination to reproduce the contents of traffic signals.

6. The method according to claim 5, further comprising:

acquiring the vehicle position information.

7. The method according to claim 5, wherein the step of determining whether to reproduce the received contents of traffic signals further comprises:

determining whether to reproduce the received contents of traffic signals according to whether the vehicle driving direction is identical to the direction represented by the at least one traffic signal indicator.

8. The method according to claim 7, wherein:

the step of receiving traffic signals further comprises receiving position information of traffic positions associated with the at least one traffic signal indicator; and the step of determining whether to reproduce the received traffic signals further comprises determining whether to reproduce the traffic signals according to the relationship between the vehicle position information and the position information of the traffic positions.

* * * * *